US005904202A

United States Patent [19]

Adamy

[11] Patent Number: 5,904,202

[45] Date of Patent: May 18, 1999

[54] DEVICE FOR EARLY DETECTION OF RUN-OUT IN CONTINUOUS CASTING

[75] Inventor: Jürgen Adamy, Igensdorf, Germany

[73] Assignee: Siemens Aktiengesellschaft, Munich, Germany

[21] Appl. No.: 08/930,926

[22] PCT Filed: Mar. 28, 1996

[86] PCT No.: PCT/EP96/01371

§ 371 Date: Feb. 2, 1998

§ 102(e) Date: Feb. 2, 1998

[87] PCT Pub. No.: WO96/31304

PCT Pub. Date: Oct. 10, 1996

[30] Foreign Application Priority Data

Apr. 3, 1995 [EP] European Pat. Off. ..... 95 104 909

[51] Int. Cl.[6] ..... B22D 11/16

[52] U.S. Cl. ..... 164/151.5; 164/450.3; 164/151.4; 164/154.1

[58] Field of Search ..... 164/151.5, 450.3, 164/451, 452, 453, 151.4, 154.1

[56] References Cited

U.S. PATENT DOCUMENTS

| | | | |
|---|---|---|---|
| 5,548,520 | 8/1996 | Nakamura | 164/151.5 |
| 5,714,866 | 2/1998 | Set et al. | 320/5 |
| 5,751,910 | 5/1998 | Bryant | 395/22 |

*Primary Examiner*—Patrick Ryan
*Assistant Examiner*—I. H. Lin
*Attorney, Agent, or Firm*—Kenyon & Kenyon

[57] ABSTRACT

For early detection of break-outs during continuous casting, the surface temperature of the strand is detected by using temperature sensors arranged in a manner distributed around the strand in the mold and is then evaluated. In order to be able to achieve as accurate a prediction as possible for break-outs with only a low computational outlay, each temperature sensor (10) is assigned a pattern recognition device (11) which, from the temperature detected and an internal state variable representing the temperature curve up to that point, updates the internal state variable on the basis of fuzzy conclusions and generates at the output a current predicted value ($P_a$) for the break-out probability.

10 Claims, 6 Drawing Sheets

DEVICE FOR EARLY DETECTION OF RUN-OUT IN CONTINUOUS CASTING

CROSS REFERENCE TO RELATED APPLICATION

This application is a 371 of PCT/EP 96/01371, filed on Mar. 28,1996.

During continuous casting, it is possible, during the growth of the strand shell in the mold, for locations to occur in the strand shell at which the said strand shell solidifies only inadequately or not at all. As soon as the strand leaves the mold, these growth faults lead to a break in the strand, through which molten steel escapes. The damage which this causes to the casting installation necessitates a relatively long shutdown of the installation and gives rise to high repair costs. Efforts are therefore made to detect growth faults in the shell before it emerges from the mold. If this is successful, the exit speed is reduced to such an extent that the potential break-out location can solidify.

Possible break-out locations are determined from the surface temperature curves measured by temperature sensors fitted in the mold in the region of the inner wall of the mold. The arrangement of the temperature sensors in a manner distributed around the strand in one or more planes offset in the direction of the strand is known. If a fault in the strand shell moves past the temperature sensors, the measured temperature rises due to the non-formation of a strand shell or the formation of a strand shell which is only weak, behind which there is molten steel, the temperature curves recorded in the case of the threat of a break-out having a characteristic shape.

To be able to predict possible breakouts from the temperature curves recorded, U.S. Pat. No. 4,949,777 describes a comparison of the change of the temperature detected by each individual temperature sensor to an average value formed from the changes in temperature detected using of all the temperature sensors and the monitoring of the results of comparison thus obtained for the exceeding of a predetermined threshold value. If the temporal and positional distribution of the threshold-value overshoots corresponds to a predetermined pattern, this is an indication of an imminent break-out.

For early detection of break-outs in the context of pattern recognition with neural networks, T. Tanaka et al.: Trouble Forecasting System by Multi-Neural Network on Continuous Casting Process of Steel Production" in T. Kohonen et al. (Ed.): Artificial Neural Networks; Proc. of the 1991 Int. Conf. on Artificial Neural Networks, Espoo, Finland, Elsevier Science Publishers B.V. (North Holland), 1991, pp. 835 to 840, describes the practice of storing the temperature curves recorded by the individual temperature sensors and analyzing them for characteristic patterns.

In a method described in Japanese Patent Application No. 4172160, the temperatures detected using the temperature sensors are fed to a neural network which generates an output signal when the three-dimensional temperature distribution exhibits a pattern characteristic of an imminent break-out.

Prediction of break-outs using neural networks which is to any extent reliable requires the presence of sufficient training data for the neural network. There is, however, the problem that training data from one installation cannot be transferred without modification to another installation. In addition, there is the fact that the decision criteria by which the prediction of break-outs takes place are essentially concealed from the operator of the installation.

Moreover, conventional methods for pattern recognition require complete temperature patterns, e.g. temperature curves, resulting in high outlay on storage. At the same time, the computational outlay is very high since each change in the temperature pattern, thus, for example, when the temperature curve has a new temperature value added to it and the oldest temperature value is simultaneously erased, requires a completely new pattern recognition operation.

SUMMARY OF THE INVENTION

An object of the present invention is to provide a device for the early detection of break-outs which, with only a low computational outlay, guarantees reliable detection of possible break-outs in a manner which can be followed by the operator of the installation.

The early detection of break-outs in accordance with the present invention is based on fuzzy pattern recognition, the rules of which are derived from knowledge of the process. The information on the temperature curves required for pattern recognition consists purely of the currently detected temperatures and of an internal state variable which represents the temperature curve up' to that point and is continuously updated. With each new temperature value, the pattern recognition system can, therefore, build on the existing results of pattern recognition, i.e. on the internal state variable, so that completely new pattern recognition on the basis of the temperature curve is not required every time. In addition, storage of the temperature curves is eliminated and, as a result, pattern recognition by means of the device according to the invention is more rapid and efficient overall than with methods which carry out pattern recognition on the basis of complete patterns.

DETAILED DESCRIPTION OF THE INVENTION

Figure 1:
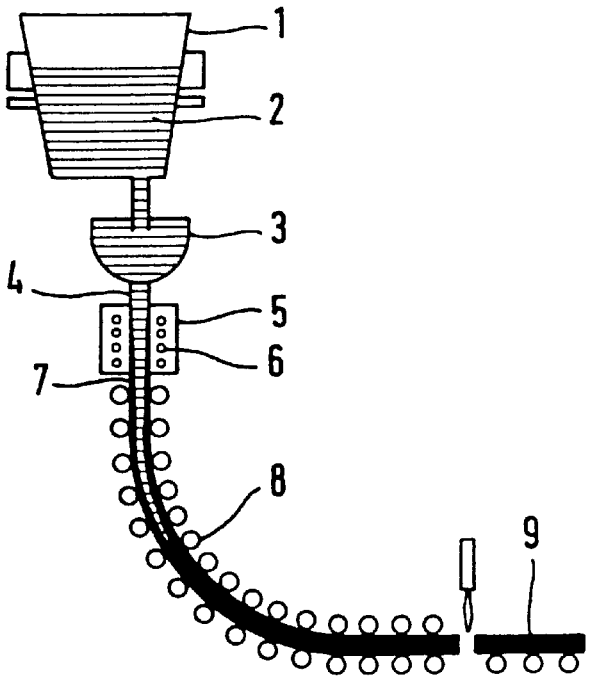
FIG. 1 shows the basic structure of a continuous casting installation.

FIG. 1 shows a continuous casting installation in schematic representation. Molten steel 2 is poured out of a casting ladle 1 into a tundish 3, which distributes the steel between various strands 4 and furthermore acts as a buffer and separator for nonmetallic particles. From the tundish 3, the steel flows into a mold 5, the inner walls of which are composed of copper and contain watercooled channels 6. Due to the heat dissipation at the inner walls of the mold 5, the steel cools and a solid strand shell 7 forms. This surrounds the molten steel, so that after leaving the mold 5, the strand 4 can be transported using rollers 8 and finally cut up into individual slabs 9.

Problems can arise if the strand shell 7 has growth faults. Frequently only a very thin solidified layer forms at certain local points, and this layer can break after leaving the mold 5. In such a case, molten steel escapes and damages the installation, with the result that a stoppage and corresponding repairs are necessary. To prevent such breaks in the strand shell 7, the growth faults in the strand shell 7 are located as they occur in the mold 5.

Figure 2:
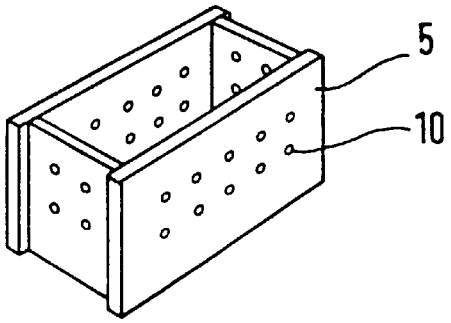
FIG. 2 shows a mold used in the continuous casting installation, with temperature sensors in the inner walls of the mold.

As FIG. 2 shows, temperature sensors 10 are for this purpose arranged in the inner walls of the mold 5 in two planes which are off set in the direction of the strand 4 in a manner distributed around the strand 4. It is also possible for a plurality of planes or just one plane to be provided. It is possible to infer the presence of a weak point in the strand shell 7 from changes in the temperature curves recorded. If a fault is detected, the casting rate is reduced, thus increasing the cooling time in the mold 5 and allowing a sufficiently solid strand shell to form at the fault location.

The most frequent growth faults by far, referred to as "adhesions", are caused by a local increase in the friction between the strand 4 and the inner wall of the mold 5. At the friction location, the strand 4 adheres more strongly to the inner wall of the mold 5 than in the surrounding area and, as a result, its speed also decreases there. This leads to stresses in the strand shell 7, causing the latter to break open. Molten steel 2 reaches the inner wall of the mold 5 and leads to a rise in temperature at that point.

Figure 3:
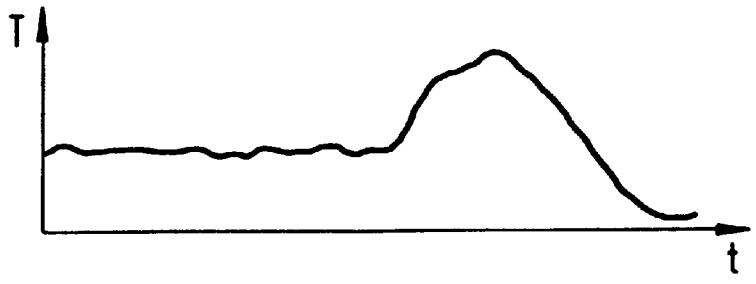
FIG. 3 shows an example of a temperature curve detected with temperature sensors for different growth faults in the strand shell.

FIG. 3 shows an example of the temperature curve recorded using one of the temperature sensors 10 when one such fault moves past the relevant temperature sensor 10. While the adhesion is passing the temperature sensor 10, a significant rise in temperature is measured. Once the adhesion has passed the temperature sensor 10, the temperature falls below the temperature level which prevails under normal casting conditions. This reduction can be traced back to a thickening in the strand shell 7 behind the adhesion this thickening having arisen at that point due to a reduction in speed.

Another cause of breaks in the strand shell 7 are air cushions, referred to as "cracks", which form between the strand 4 and the mold 5.

Figure 4:
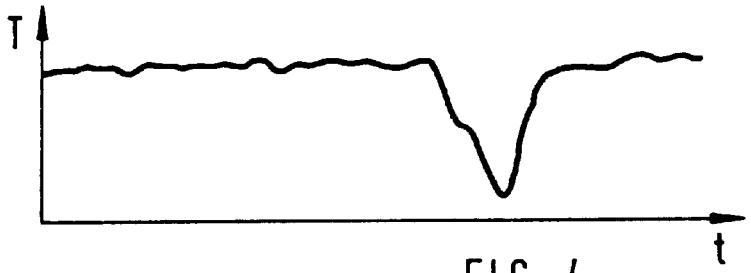
FIG. 4 shows another example of a temperature curve detected with temperature sensors for different growth faults in the strand shell.

FIG. 4 shows an example of the temperature curve recorded when a fault of this kind occurs. The low thermal conductivity of the air causes a sharp reduction in the dissipation of heat from the strand 4 to the mold 5 and, as a result, only a very thin strand shell 7 forms. When a crack passes one of the temperature sensors 10, it is reflected in a marked dip in the temperature curve recorded. Together, adhesions and cracks cause over 90% of break-outs.

The various growth faults in the strand shell 7 give rise to characteristic patterns in the temperature curves recorded. These patterns are formed sequentially, new measured values being added to a temperature curve.

Figure 5:
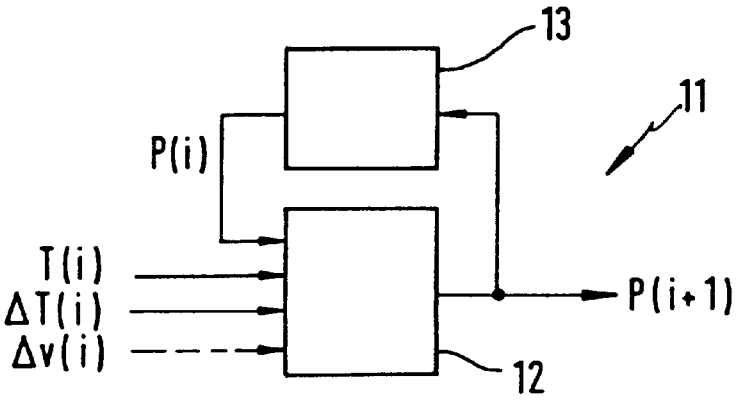
FIG. 5 shows an example of a fuzzy pattern recognition device for the formation of a predicted value for the break-out probability on the basis of the temperature curve.

FIG. 5 shows an example of a pattern recognition device 11 which, from the current temperature values T(i) detected in time steps i using a temperature sensor 10 and from the changes in temperature $\Delta T(i)=T(i)-T(i-1)$ with respect to time, continuously determines the probability P(i+1) that an adhesion or crack pattern is developing in the temperature curve recorded. Since pattern recognition cannot be performed solely using the current values T(i) and $\Delta T(i)$, the respective previously determined break-out probability P(i) is, in addition, used as an internal state variable representing the temperature curve up to that point and fed together with the current measured values T(i) and $\Delta T(i)$ to a fuzzy logic unit 12 which, from this, determines the current break-out probability P (i+1) . This probability is buffer-stored in a storage element 13 and fed back to the input of the fuzzy logic unit 12 in the next time step. The buffer storage and feedback of the break-out probability P(i) determined in the respectively preceding time step enables the fuzzy logic unit 12 to carry out pattern recognition with reference solely to the current temperature T(i) and its change $\Delta T(i)$, i.e. without knowing the temperature curve.

Figure 6:
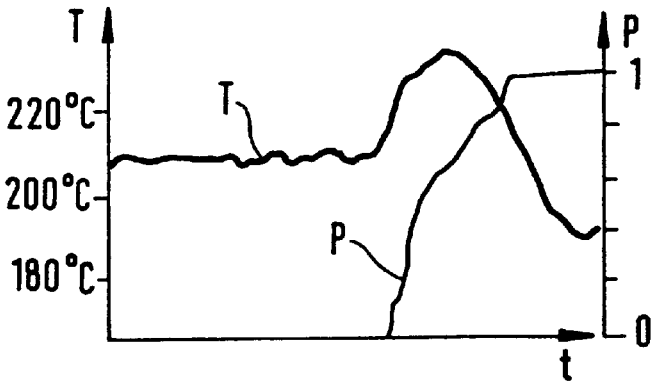
FIG. 6 shows an example of a temperature curve detected upon occurrence of a particular growth fault together with the break-out probability determined as a function of the temperature curve.

To illustrate the operation of the pattern recognition device 11, the temperature curve T of an adhesion as shown in FIG. 6 will be considered by way of example:

Under normal casting conditions, the temperature T is constant and its change with respect to time fluctuates very little. The probability P of a break-out is zero.

At the beginning of an adhesion, the temperature T rises. The probability P is therefore increased to a small positive value, for example 0.1.

In the further course of the adhesion, the temperature T rises, and the change in the temperature T with respect to time also increases. If the probability P from the previous step is small, this being equivalent to the observation of the beginning of an adhesion, the probability P is increased to a moderate value, e.g. 0.4. if, on the other hand, the probability P from the previous step is not small, i.e. there is the beginning of an adhesion, the probability P is not changed either The increase in temperature caused by the adhesion now reaches its maximum value, the change in the temperature T with respect to time simultaneously falling to zero. If, up to this point in time, the temperature curve has been that typical for an adhesion and a moderate break-out probability P has hence been detected up to this point, the probability P is increased to a high value, e.g. 0.7.

The adhesion has now passed the temperature sensor 10 and the temperature T falls to moderate values with a negative change in temperature. Following the above scheme, the probability P is then increased further, e.g. to 0.9, assuming it is already at a high value.

Owing to the thickening of the strand shell 7 at the end of an adhesion, the temperature T finally decreases to such an extent that it is below the temperature level under normal casting conditions. As soon as this occurs and the value of the probability P based on events thus far is very high, the probability P is increased to its maximum value, e.g. 1.0.

Figure 7:
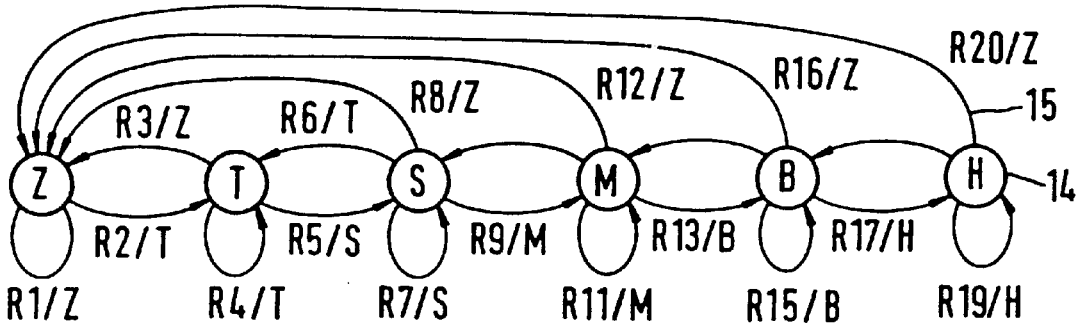
FIG. 7 shows an example of the fuzzy states of the fuzzy pattern recognition device.

FIG. 7 shows the fuzzy state graph of the pattern recognition device 11. The states, i.e. the linguistic values of the break-out probability P(i), form the nodes 14 of the state graph. The probability P(i) can assume the following linguistic values:

Z=0, T=very low, S=low, M=moderate, B=high, H=very high.

At the transition arrows 15 between the states 14 the transition conditions, i.e. the fuzzy rules which bring about a change of state, are positioned in front of the slash; the value which follows the slash indicates the respective newly attained state. In the course of pattern recognition, the probability P(i) is increased stepwise from Z to R only when the temperature pattern entails that the rule sets R2, R5, R9, R13 and R17 have successively been fulfilled. This is the case with adhesion or crack patterns. If the temperature pattern detected differs only slightly from these reference patterns, then either the instantaneous state is retained or the next-lowest state is adopted. If the deviations are larger, then, depending on the current state reached, one of rule sets R3, R8, R12, R16 and R20 becomes active and the probability P(i) becomes Z.

Changes in the casting rate have a major effect on the temperature curves characteristic of breaks in the strand shell 7. It is desirable to take into account these changes Δv(i) in the pattern recognition, as illustrated in broken lines in FIG. 5. If, for example, the casting rate increases, the dwell time and hence also the cooling time of the strand 4 in the mold 5 decreases. At the same time, this means an increase in the measured temperature. If during a change in the casting rate, growth faults then occur in the strand shell 7, the temperature curves typical of them are distorted.

Figure 8:
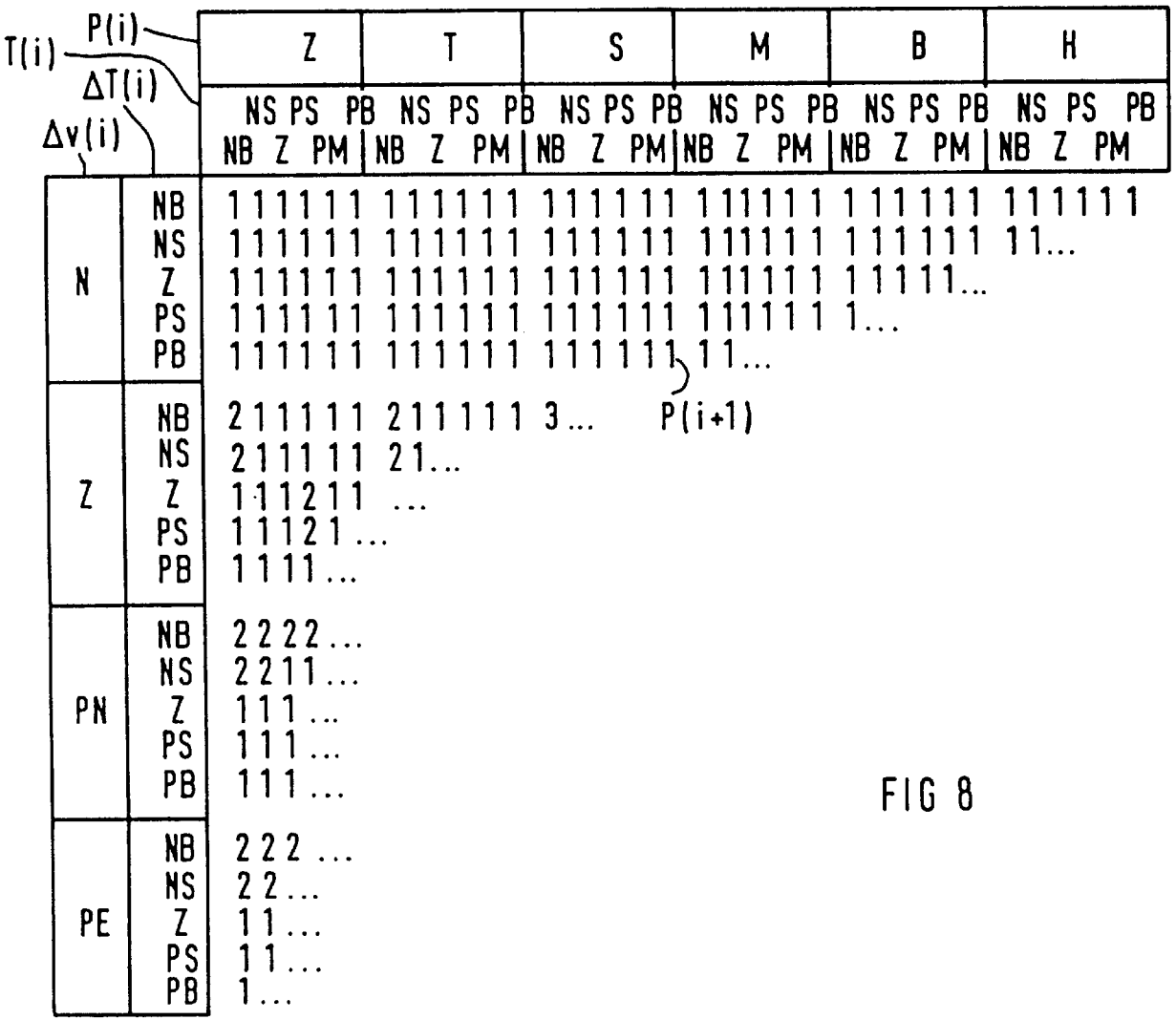
FIG. 8 shows an example of the fuzzy control array of the pattern recognition device.

FIG. 8 shows an example of a fuzzy control array which is implemented in the fuzzy logic unit of the pattern recognition device 11 and in which, in addition to the detected temperature T(i) and the change in temperature ΔT(i), the change in the casting rate Δv(i) is used to determine the break-out probability P(i) . otherwise, the fuzzy state graph shown in FIG. 7 and the fuzzy control array illustrated in FIG. 8 are equivalent to one another. The rules of the control array specify the combinations of linguistic values of the input variables T(i), ΔT(i) and Δv(i) which must be met to ensure that the pattern recognition device 11 changes or maintains its state. The temperature T (i) is assigned the following values:

NB=large negative, NS=small negative, Z=zero, PS=small positive, PM=medium positive, PB=large positive.

The change in temperature ΔT(i) is assigned the following values:

NB=large negative, NS=small negative, Z=zero, PS=small positive, PB=large positive.

The following values are provided for the change in the casting rate Δv(i):

N=negative, Z=zero, PN=normal positive, PE=extreme positive.

The internal state variable, i.e. the buffer-stored probability P(i), assumes the following linguistic values:

Z=zero, T=very low, S=low, M=moderate, B=high, H=very high.

For each combination of values for the temperature T(i), the change in temperature ΔT(i), the change in the casting rate Δv(i) and the buffer-stored probability PM there results in each case a specific linguistic value for the break-out probability P(i+1) predicted by the pattern recognition device 11. For the sake of clarity, the linguistic values of the predicted break-out probability P(i+1) are coded as follows: Z=1, T=2, S=3, M=4, B=5, H=6.

All the rules of the fuzzy logic unit 12 can be read out from the control array. Thus, for example, the following applies: if P(i)=Z and Δv(i)=Z and T=Z and ΔT=Z, then P(i+1)=1(=Z).

The inference is performed in accordance with the max-min method and defuzzification in accordance with the centroid method.

Figure 9:
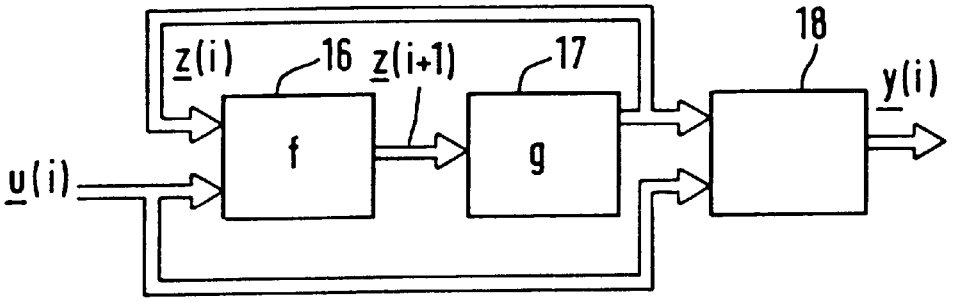
FIG. 9 shows an exemplary embodiment of a pattern recognition device.

FIG. 9 shows a generalized exemplary embodiment of the pattern recognition device, in which the input variables T(i), ΔT(i) and Δv(i) are combined in an input vector $\underline{u}(i)$. From the input vector $\underline{u}(i)$ and a buffer-stored internal state vector $\underline{z}(i)$, a first fuzzy logic 16 generates an updated state vector $\underline{z}(i+1)$, which is buffer-stored in a storage element 17. The buffer-stored state vector $\underline{z}(i)$ and the input vector unit $\underline{u}(i)$ are linked in a second fuzzy logic unit 18 to give an output vector y. The pattern recognition device 11 shown in FIG. 5 is a special case of the device shown in FIG. 9 with just one internal state variable z(i)=P(i), one output variable y(i)=P(i+1) and with corresponding transfer behavior of the first fuzzy logic unit 16 and the second fuzzy logic unit 18, i.e. f=g.

Figure 10:
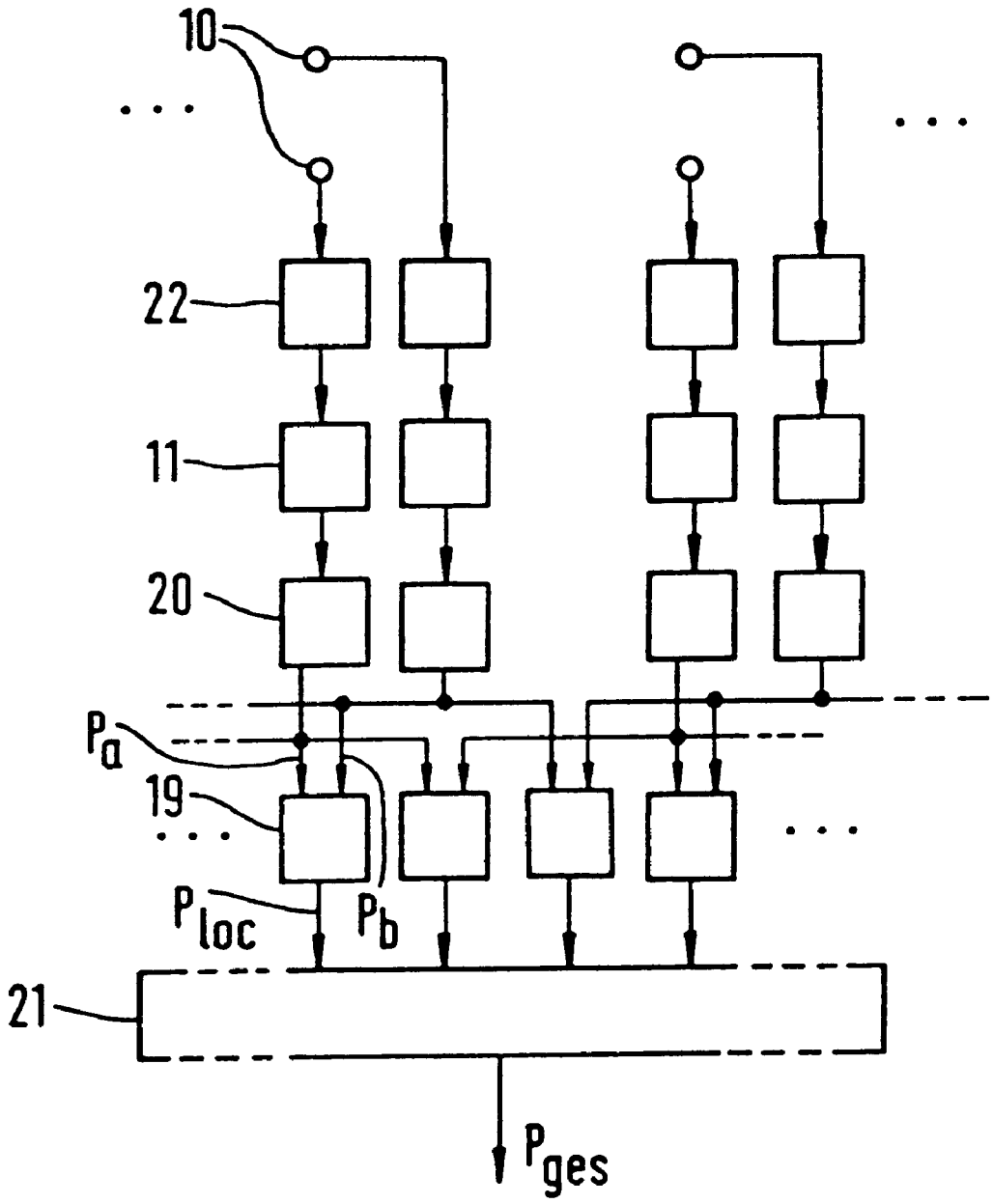
FIG. 10 shows an example of a device for predicting the overall probability of break-outs.

FIG. 10 shows an example of a device for predicting the overall probability of break-outs on the basis of the individual temperature curves recorded using the temperature sensors 10. The patterns of certain growth faults in the strand shell 7 are reflected not just in one temperature curve but also, due to the extent of the growth fault and the movement of the strand 4, in temperature curves measured at adjacent points. As FIG. 10 shows, each temperature sensor 10 has its own pattern recognition device 11 connected to its output and this pattern recognition device monitors the respectively recorded temperature curve for the occurrence of a given pattern. To make the detection of growth faults in the strand shell 7 more reliable, the predicted values $P_a$ and $P_b$ supplied by the pattern recognition devices 11 of in each case two directly adjacent temperature sensors 10 are combined in a logic device 19 to give a local break-out probability $P_{loc}$, In this way, erroneous pattern recognitions of a single pattern recognition device 11 are corrected in that the local break-out probability $P_{loc}$ is only assigned a high value if both $P_a$ and $P_b$ each have high values. The detection of adhesions or cracks is also improved since it is possible, from increased values for the individual probabilities $P_a$, $P_b$, to infer a local break-out probability $P_{loc}$ which is higher than any of the individual probabilities $P_a$, $P_b$ Logical linking of the individual probabilities $P_a$ and $p_b$ to give the local break-out probability $P_{loc}$ is preferably based on the basis of fuzzy conclusions.

Since the growth faults in the strand shell 7 move past the individual temperature sensors 10, it being possible for the direction of motion and the propagation of the growth faults to take place in different ways, the pattern recognition results $P_a$ and $p_b$ may exhibit a time offset from the pattern recognition devices 11 of two adjacent temperature sensors 10 for the same growth fault. To enable both pattern recognition results $P_a$ and $P_b$ to be combined in the logic device 19, however, they must be present simultaneously. For this reason, each pattern recognition device 11 has a delay device 20 arranged on its output side, using which this time offset is compensated for. The delay devices 20 each comprise a maximum-value holding element which determines the maximum value $P_{max}(i)=\max(P(i-k), \ldots ,P(i))$ of the last k time steps from each individual probability P(i) at the output of the pattern recognition device 11 on its input side and feeds it to the logic device 19.

In a logic circuit 21 arranged on the output side of all the logic devices 19, the maximum value of all the local break-out probabilities $P_{loc}$ is determined, this then representing the overall probability $P_{ges}$ of a breakout.

The pattern recognition in the pattern recognition devices 11 must be independent of differences in the plant and operating conditions. A device 22 for measured-value conditioning is arranged between each temperature sensor 10 and the associated pattern recognition device 11. In this device, the input variables of the pattern recognition device 11, i.e. the temperature T, the change in the temperature ΔT with respect to time and the change in the casting rate Δv with respect to time are normalized or transformed in such a way that differences in plant conditions or changing process conditions affect the recognition of adhesion and crack patterns only slightly, if at all.

Figure 11:
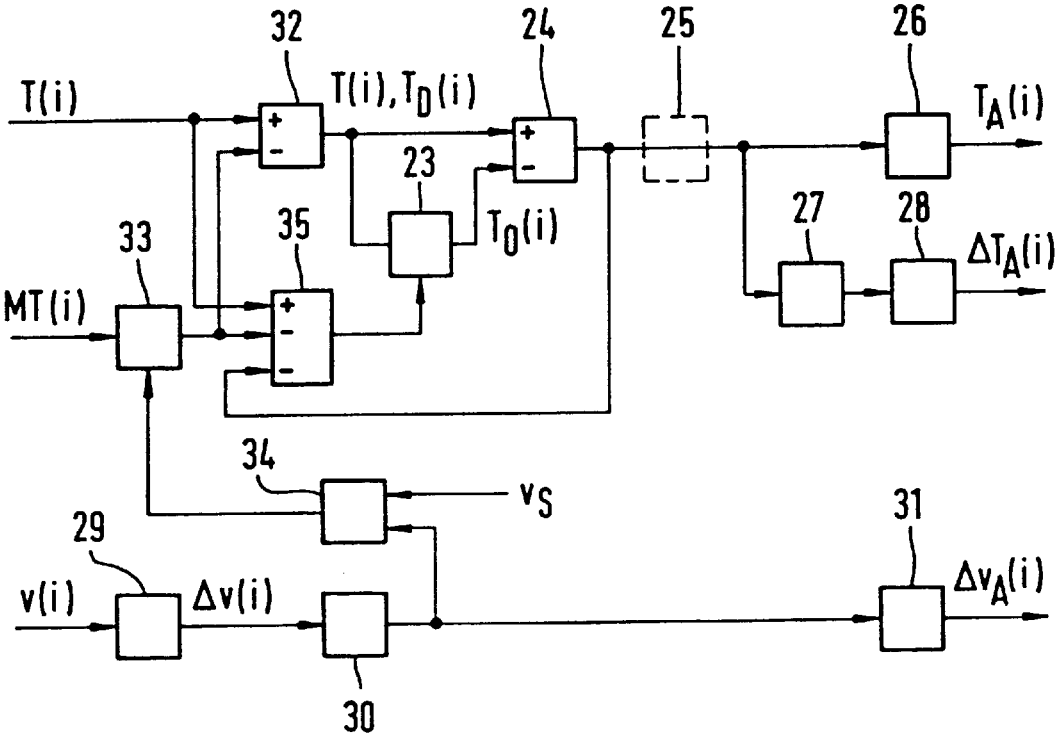
FIG. 11 shows an example of a device for measured-value conditioning of the signals fed to the pattern recognition device.

FIG. 11 shows a block diagram of a device 22 of this kind for measured-value conditioning. The temperature values T(i) measured in a time step i are relatively constant at between about 100° C. and 200° C. under normal casting conditions, depending on differences in the plant and operating conditions. Adhesions and cracks cause deviations of up to 50° C. from this constant offset temperature To. The pattern recognition device 11 can only recognize adhesion and crack patterns if these start from a temperature level which is always constant. To achieve this, an offset temperature To is determined by means of a first-order discrete-time filter 23 and subtracted in a subtraction device 24 from the current temperature value T (i) . The temperature $T_A(i)=T(i)-T_o(i)$ thus obtained is smoothed in a filter 25 to suppress noise, if required, and then fed to a normalization device 26, in which the temperature deviations from the normal temperature level caused by typical growth faults are limited to a range of values between zero and one. The normalized temperature value $T_A(i)$ thus obtained is then fed to the pattern recognition device 11.

The pattern recognition device 11 furthermore receives the change in the temperature $\Delta T_A(i)$ With respect to time, which is formed in a device 27 using the difference quotient of the output signal of the subtraction device 24 and is then normalized in another normalization device 28 to a range of values between zero and one.

As already explained above, the change in the casting rate with respect to time can also be an input variable of the pattern recognition device 11. There, it changes the rules for the pattern recognition in such a way that adhesions and cracks can still be reliably detected even if their patterns are distorted because of the change in the casting rate. The change in the casting rate $\Delta v(i)$ with respect to time is determined in a device 29 using the difference quotient of the casting rate v(i). Often, the casting rate v(i) is not increased steadily but abruptly. However, the resulting rise in temperature caused by the shorter cooling time in the mold 5 does take place steadily over a certain period of time. To achieve a corresponding change in the rules for pattern recognition during the entire rise in temperature, the value $\Delta v(i)$ must be set to a correspondingly high value during the rise in temperature, this value simulating a steady rise in the casting rate v(i). This is accomplished using a maximum-value holding element 30 which, at its output, in each case generates the highest positive value of $\Delta v(i)$ from the last k time steps. The following thus applies:

$\Delta v_A(i)=\max(\Delta v(i-k), \ldots, \Delta v(i)$ for $\Delta v(i)>0$ and $\Delta v_A(i)=\Delta v(i)$ for $\Delta v(i)\leqq 0$.

Finally, the value of $\Delta v_A(i)$ thus obtained is normalized in a normalization device 31 before it is fed to the pattern recognition device 11.

As has already been mentioned, the effect of changes in the casting rate with respect to time on the temperature curves can be taken into account by changing the rules for pattern recognition. Another possibility of reducing the effect of the changes in the casting rate consists in eliminating the resultant changes in temperature in the temperature curves recorded even before pattern recognition. This is accomplished by averaging all temperature values T(i) supplied simultaneously by the temperature sensors 10 of one plane in the mold 5 in each case and subtracting the average MT(i) thus obtained from the individual temperature values T(i) in a subtraction device 32. The temperature difference $T_D(i)=T(i)-MT(i)$ thus obtained is independent of changes in the temperature caused by changes in the casting rate and is subsequently fed to the filter 23 and subtraction device 24. In this case, the adaptation of pattern recognition by $\Delta v_A(i)$ can also be dispensed with, thereby simplifying the structure of the device for early detection of break-outs.

As an alternative, provision can be made to work without compensation of the casting rate in the case of a constant casting rate v(i) or small changes in the casting rate v(i), in order to avoid introducing disturbances into the individual temperature curves $T_A(i)$ via the average MT(i) . For this purpose, the average MT(i) of the comparison device 32 is fed via a controllable switching device 33 which allows the average MT(i) through to the comparison device 32 only when the change in the casting rate $\Delta v_A(i)$ exceeds a predetermined threshold $v_s$. For this purpose, the values $\Delta v_A(i)$ and $v_s$ are fed to a threshold-value detector 34, the output of which controls the controllable switching device 33. To avoid an abrupt change in the value $T_A$ (i) due to the connecting up of the average MT (i), the value $T_o(i+1)$ of the filter 23 is set by way of the output of a subtraction device 35 using $T_o(i+1)=T(i)-MT(i)-T_A(i)$ in such a way that the curve of $T_A(i)$ is continued steadily.

What is claim is:

1. A device for early detection of break-outs during continuous casting, comprising:

a mold;

a plurality of temperature sensors arranged in the mold and distributed around a strand, the temperature sensors detecting a temperature; and pattern recognition devices, each cooperating with a respective one of the plurality of temperature sensors and generating at an output thereof a current predicted value as a function of the detected temperature and at least one previous predicted value, each of the current predicted value and the at least one previous predicted value corresponding to a respective break-out probability.

2. The device according to claim 1, wherein each of the pattern recognition devices modifies a current internal state variable as a function of the detected temperature, a previous internal state variable and a fuzzy conclusion, the previous and current internal state variables corresponding to a temperature curve, and wherein the current internal state variable is equal to the current predicted value, and the previous internal state variable is equal to the at least one previous predicted value.

3. The device according to claim 1, wherein each of the pattern recognition devices evaluates a current value of the detected temperature and a change of the detected temperature.

4. The device according to claim 1, wherein each of the pattern recognition devices evaluates a change in a casting rate to generate the current predicted value.

5. The device according to claim 1, further comprising:

a measured-value conditioning unit arranged between each of the temperature sensors and an associated one of the pattern recognition devices, the unit subtracting a time average determined as a function of the temperature curve from the detected temperature, the time average being an average of a plurality of temperature values measured over a predetermined time period by a single sensor of the temperature sensors.

6. The device according to claim 5, wherein the measured-value conditioning unit subtracts an average temperature from the detected temperature, the average temperature being formed as a function of temperature values simultaneously detected by the plurality of temperature sensors distributed around the strand in a same plane.

7. The device according to claim 1, wherein each of the pattern recognition devices is assigned to at least two directly adjacent temperature sensors, the output of each of the pattern recognition devices being coupled to a logic device, the logic device linking the predicted values provided by each of the pattern recognition devices to generate a probability value for a local break-out in a vicinity of the at least two directly adjacent temperature sensors.

8. The device according to claim 7, wherein the temperature sensors are arranged one on top of another, and further comprising:

a delay device coupled to the output of each pattern recognition device, wherein at least one first sensor of the temperature sensors generates output values which are delayed with respect to at least one second sensor of the temperature sensors, the at least one first sensor positioned above the at least one second sensor.

9. The device according to claim 8, wherein the delay device generates a maximum value of a predetermined number of the predicted values previously provided thereto.

10. The device according to claim 7, comprising:

a common logic circuit coupled to the outputs of the logic devices, the common logic circuit determining an overall probability value of a break-out as a function of probabilities of local break-outs.

* * * * *